US006991245B1

(12) United States Patent
Pate, Jr.

(10) Patent No.: US 6,991,245 B1
(45) Date of Patent: Jan. 31, 2006

(54) BOAT-TRAILER LAUNCH AND RECOVERY DEVICE

(76) Inventor: Joseph Pate, Jr., 1520 Bender Ave., Hamilton, OH (US) 45011

( * ) Notice: Subject to any disclaimer, the term of this patent is extended or adjusted under 35 U.S.C. 154(b) by 0 days.

(21) Appl. No.: 10/902,195

(22) Filed: Jul. 29, 2004

(51) Int. Cl.
*B63B 21/00* (2006.01)

(52) U.S. Cl. ..... 280/414.1; 114/230.1

(58) Field of Classification Search ..... 280/414.1; 401/77; 114/230.1, 230.15, 230.17
See application file for complete search history.

(56) References Cited

U.S. PATENT DOCUMENTS 3,060,885 A * 10/1962 Nolf ..... 114/230.16
4,919,446 A * 4/1990 Higgins ..... 280/414.1
5,599,035 A * 2/1997 Spence ..... 280/414.1
5,666,901 A 9/1997 Jone
5,895,185 A * 4/1999 Spence ..... 410/77
6,000,356 A * 12/1999 VanAssche et al. ..... 114/230.1
6,598,896 B1 * 7/2003 Hyslop ..... 280/414.1

* cited by examiner

*Primary Examiner*—Kevin Hurley
(74) *Attorney, Agent, or Firm*—William M. Selenke

(57) ABSTRACT

The boat-trailer launch and recovery device has a right rail and a left rail, which rails are attached to a trailer post by holding plates. The right rail and the left rail each have a bend section. A spring loaded gate is attached to either the right rail or the left rail. A stop bar connects the right rail and the left rail between the spring loaded gate and the trailer post. Attached to the bow of work piece boat is a removable bow post, which bow post has a socket, an inner core pipe section, and an outher PVC sleeve which freely rotates around the inner core pipe section. The outer PVC sleeve is held in place with a collar and a collar set screw with a cap at top. The right rail and the left rail each have one or more trailer post adjustment holes and one or more gate adjustment holes. The trailer post holding plates have four or more bolt holes to adjust the height of the rails.

5 Claims, 6 Drawing Sheets

BOAT-TRAILER LAUNCH AND RECOVERY DEVICE

FIELD OF INVENTION

The invention is concerned with devices that aid in the launching and recovery of boats ° from boat-trailers. The invention is concerned with the easy replacement on a trailer of the boat after the outing. More specifically it is concerned with devices that have two rails which rails will accept and retain a vertical bow post that is removable from the bow of the boat. The device physically aligns the bow of the boat and guides boat to a loaded and latched position on boat trailer.

BACKGROUND OF INVENTION

Most privately used boats are not stored and maintained in water marinas. Most such boats are placed or launched in water when desired. After an outing is over the boat is commonly removed from water and stored near the body of water or is returned with the boat owner to the owners private resident. Typically, the boat launching area consists of a concrete slab that originates on the shore and gradually slopes into the water to a depth of four or more feet of water.

When the boat is transported on public roadways at relatively high speeds, that boat is securely affixed to the boat trailer with various straps, and such. The bottom of the boat typically rests upon two or more padded strips on the upper surface of the boat trailer. When the boat owner wishes to launch his boat he backs the trailer into the launching ramp to a proper depth.

Prior to the backing of the boat trailer into the water many if not most of the retaining straps that fasten the boat to the boat trailer are removed. Typically the boat which is being launched from the trailer is retained in place with a cable between bow eye and a winch on the trailer. Thus as the boat is backed into the water the boat is free to float. At the proper depth a second person will release the cable that held the boat on the trailer. He will then climb into the boat and back the boat off the boat trailer and drive the boat to an area removed from launch ramp.

When the boat is recovered, the process is reversed. The boat trailer is backed down the ramp into the water to a sufficient depth. The boat is driven onto the trailer and a small cable winch is used to pull the boat to its proper place on the trailer. Once the cable affixes the boat to the trailer, the boat trailer with the boat now on board is removed from the water and towed to a convenient area. The boat is tied down and fastened firmly to the trailer for transport. Typically the launch-recovery process is a two-person job.

This general procedure has been used by millions of boating enthusiasts for decades.

There have been various patented devices to aid in the attachment of the boat to the boat trailer. Of interest is U.S. Pat. No. 5,666,901 issued to Jones. Jones teaches a device with two metal guide bars which are affixed to a plate that is mounted on the bow of the boat. This device will engage and attach to an upwardly extending angle on the boat trailer. The present invention has several important advantages compared to the Jones patent. Most importantly his device is permanently attached to the bow of the boat. This is quite inconvenient. First it is constantly attached and could easily damage a boat if were accidentally hit. Secondly, the added weight in the bow of the boat could affect the boat handling. Thirdly, the Jones device would interfere with both a front mounted trolling motor and the required navigation lights.

Finally, the Jones invention does not permit an adjustment of the angle of the device to the extending bar. This is important because the angle of launching ramp relative to the surface of the water varies.

The present invention comprises a removable bow post that extends upwardly from the bow of the boat. This bow post is removed and stored in the boat when the boat is not being launched or recovered. Some trailers have a rigid upright trailer post toward the front of the trailer. These upright trailer posts may have an attached short ladder if that trailer is used for larger boats. Optionally, the present invention has an attachable upright trailer post, if the work piece trailer does not have such an upright post.

Affixed to this upright trailer post are a right rail and a left rail which progress in parallel from the upright trailer post toward the rear of the trailer. At a distance from the upright post the right rail and the left rail are bent away from each other to provide a v-shaped entrance area for the bow post mounted on the bow of the boat. Within the space between the right rail and the left rail is a gate which reversible, closes with resilient means (a spring) to capture the bow post.

DETAILED DESCRIPTION OF THE FIGURES

Figure 1:
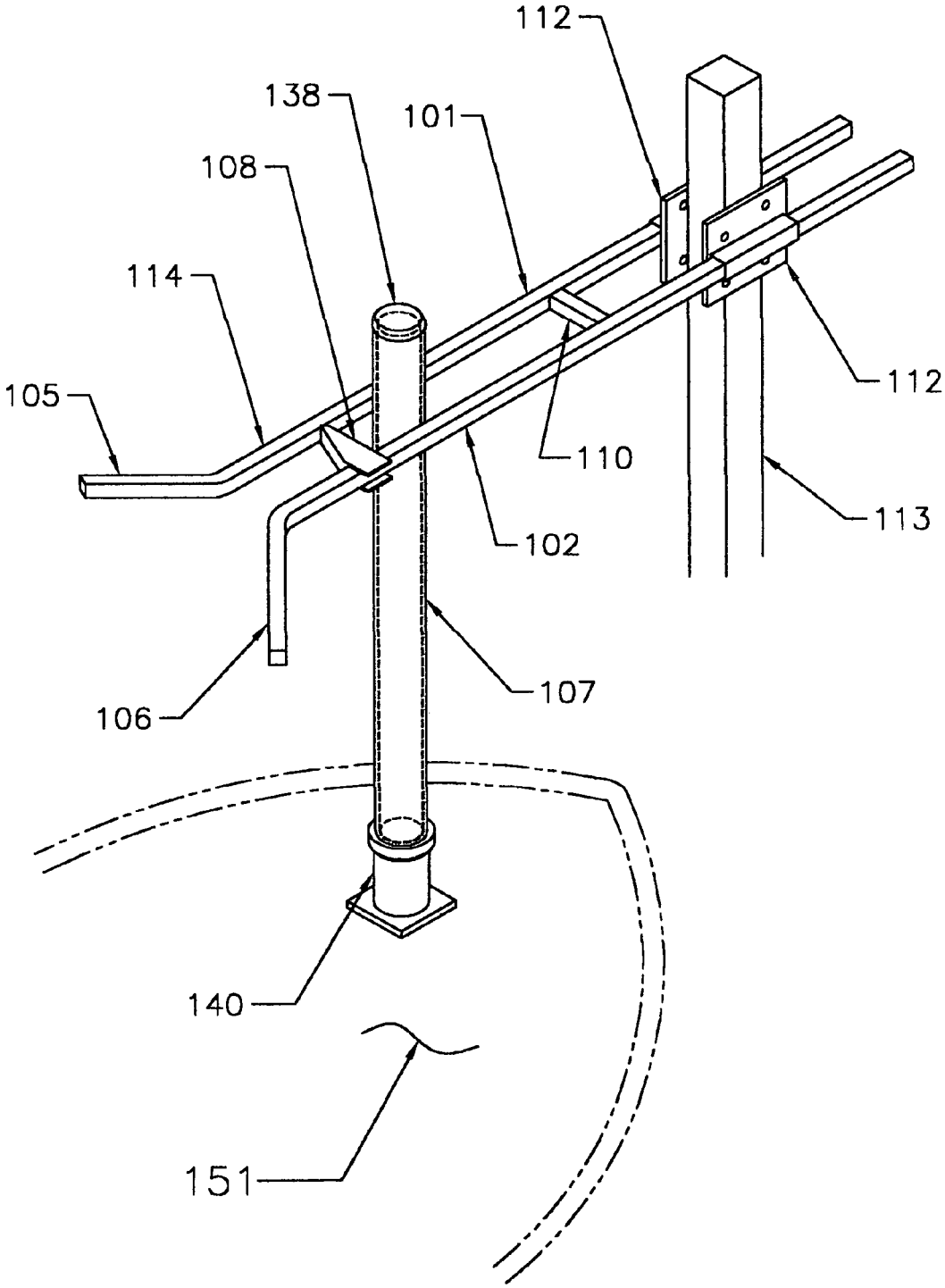
FIG. 1 shows the perspective view of the boat-trailer launch & recovery device.

FIG. 1 shows the perspective view of the boat-trailer launch & recovery device 114. It comprises a right rail 101 and a left rail 102. Right rail 101 has a bend section 105. Left rail 102 has a bend section 106. Removable bow post 107 is shown. Spring loaded gate 108 is shown. A stop bar 110 limits forward motion of the bow post 107. Rail 101 and 102 are affixed to a trailer post 113 by holding plates 112.

Figure 2:
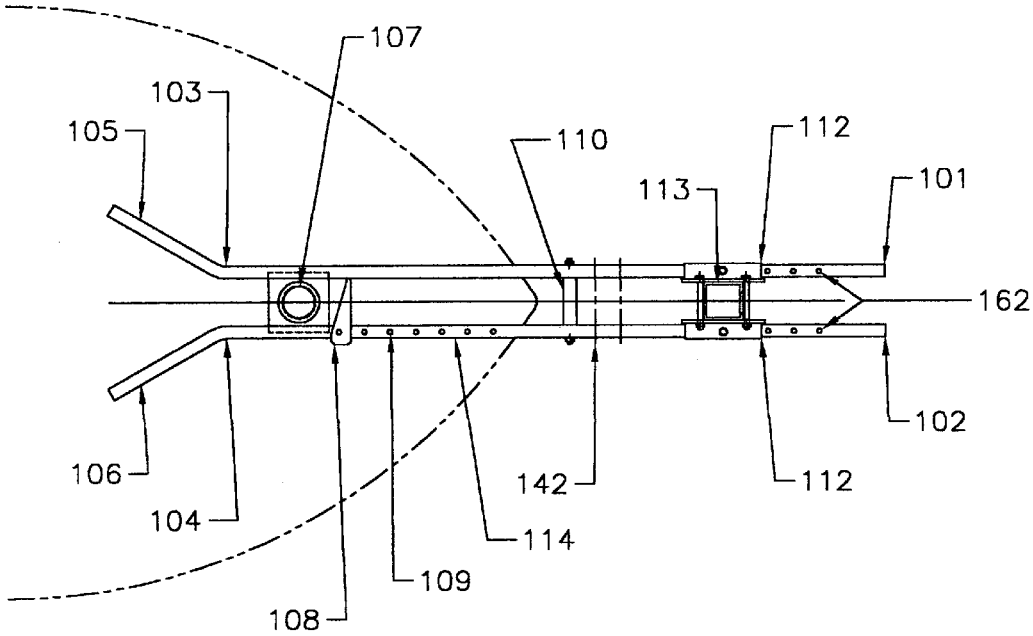
FIG. 2 shows the top view of the boat-trailer launch & recovery device.

FIG. 2 show the top view of the boat-trailer launch & recovery device 114. It comprises a right rail 101 and a left rail 102. The right rail 101 has a rail bend 103 and a bend section 105. Left rail 102 has a rail bend 104 and a bend section 106. The top of bow post 107 is shown. Spring loaded gate 108 can be removably affixed to a series of gate holes 109 in rail 102. Holes 109 may be in either the right rail or left rail. A stop bar 110 limits forward motion of the bow post 107. Rails 101 and 102 are affixed to a trailer post 113 by holding plates 112 and bolts 111.

Figure 3:
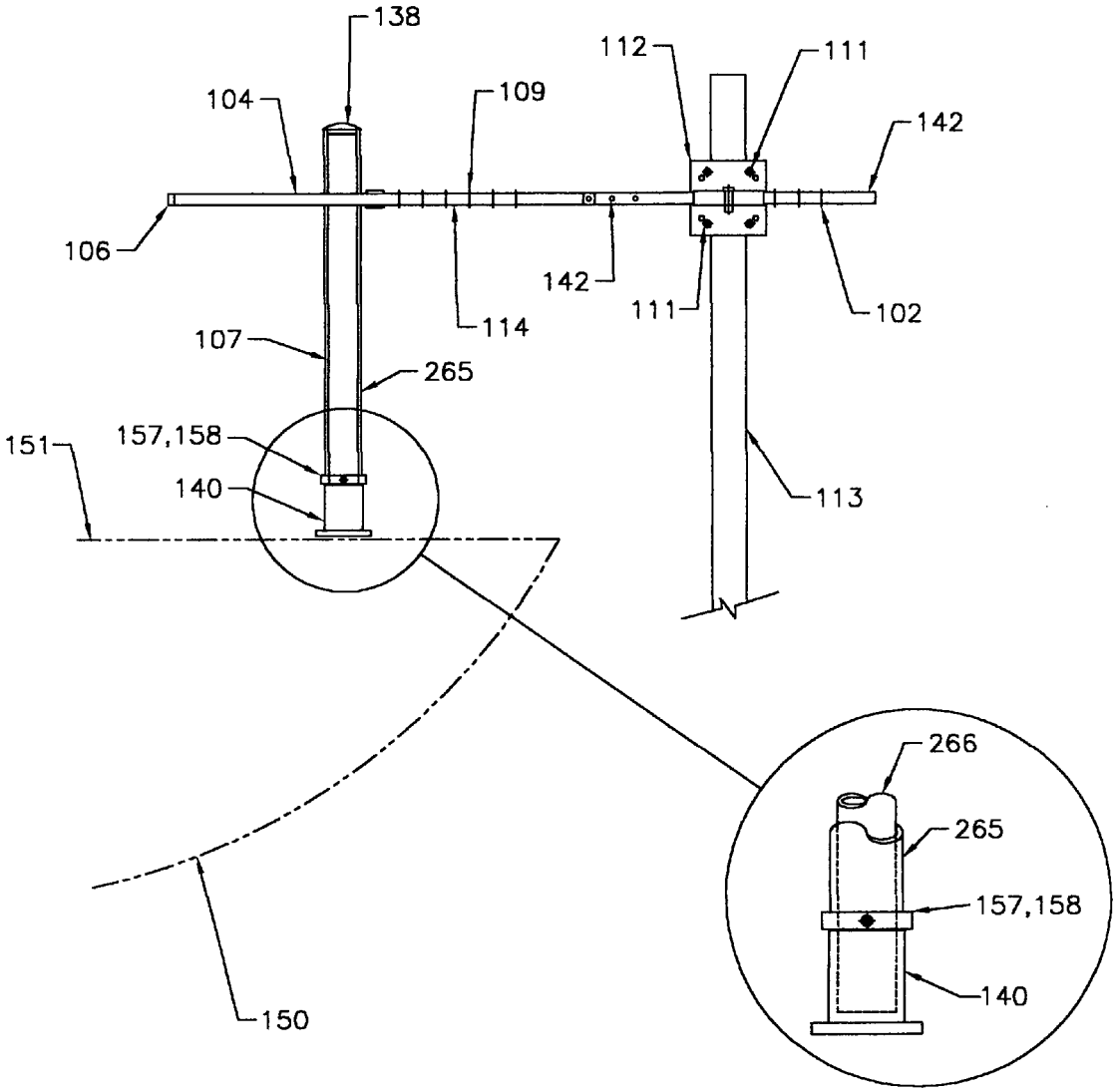
FIG. 3 show the side view of the boat-trailer launch & recovery device, with a detail of the bow post.

FIG. 3 shows the side view of the boat-trailer launch & recovery device 114. Shown is boat bow post 107 which has a cap 138. Bow post 107 is reversibly affixed to the work piece boat bow deck 151 with a socket 140. Bow post 107 has an inner core pipe section 266. An outer PVC sleeve 265 freely rotates around inner core pipe section 266. PVC sleeve 265 is held in place with collar 157 and collar set screw 158 and cap at top. Left rail 102 is shown attached to the optional work piece trailer post 113 with plat 112 and bolts 111. The useful length of the device rails 101 and 102 may be changed by trailer post adjustment holes 142.

Figure 4:
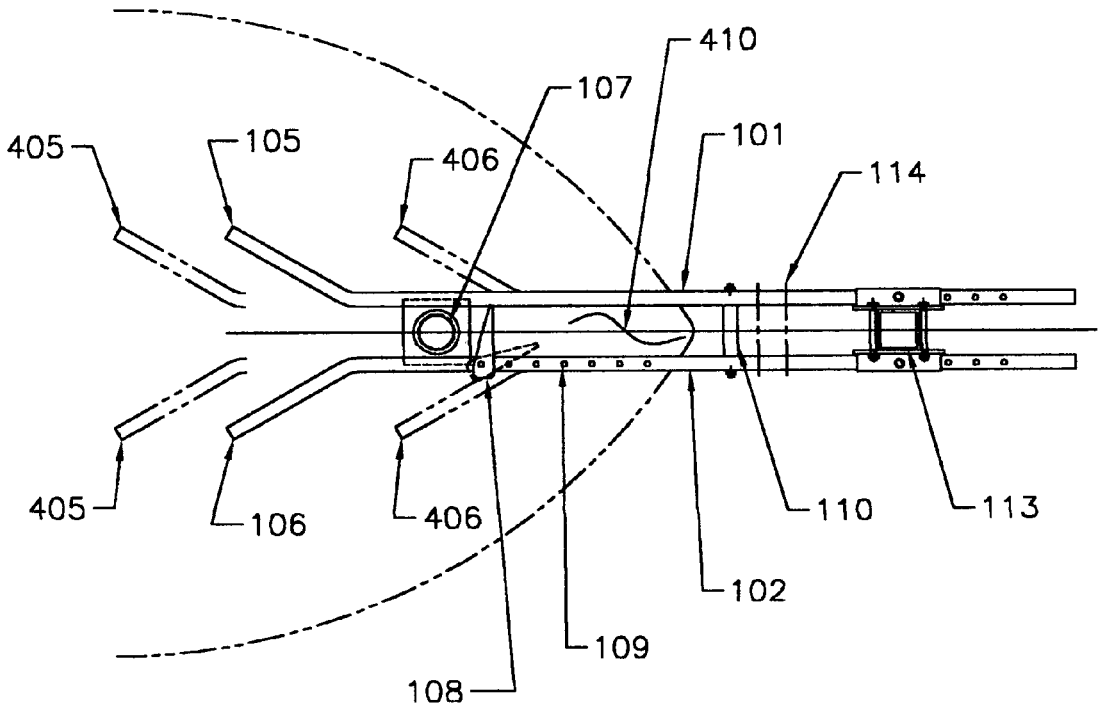
FIG. 4 shows in a top view of the boat-trailer launch & recovery device that the length of the rails of the device may be adjusted.

FIG. 4 shows in a top view of the boat-trailer launch & recovery device 114. It further shows that the length of right rails 101 and left rail 102 may be adjusted. The top of bow post 107 with cap 138 is shown. Spring loaded gate 108 can be removably affixed to a series of holes 109. A stop bar 110 limits forward motion of the bow post 107. Rail 101 and 102 are affixed to a trailer post 113. Phantom bend sections 405 and 406 indicate that various adjustments that can be made in the length of rails 101 and 102.

Figure 5:
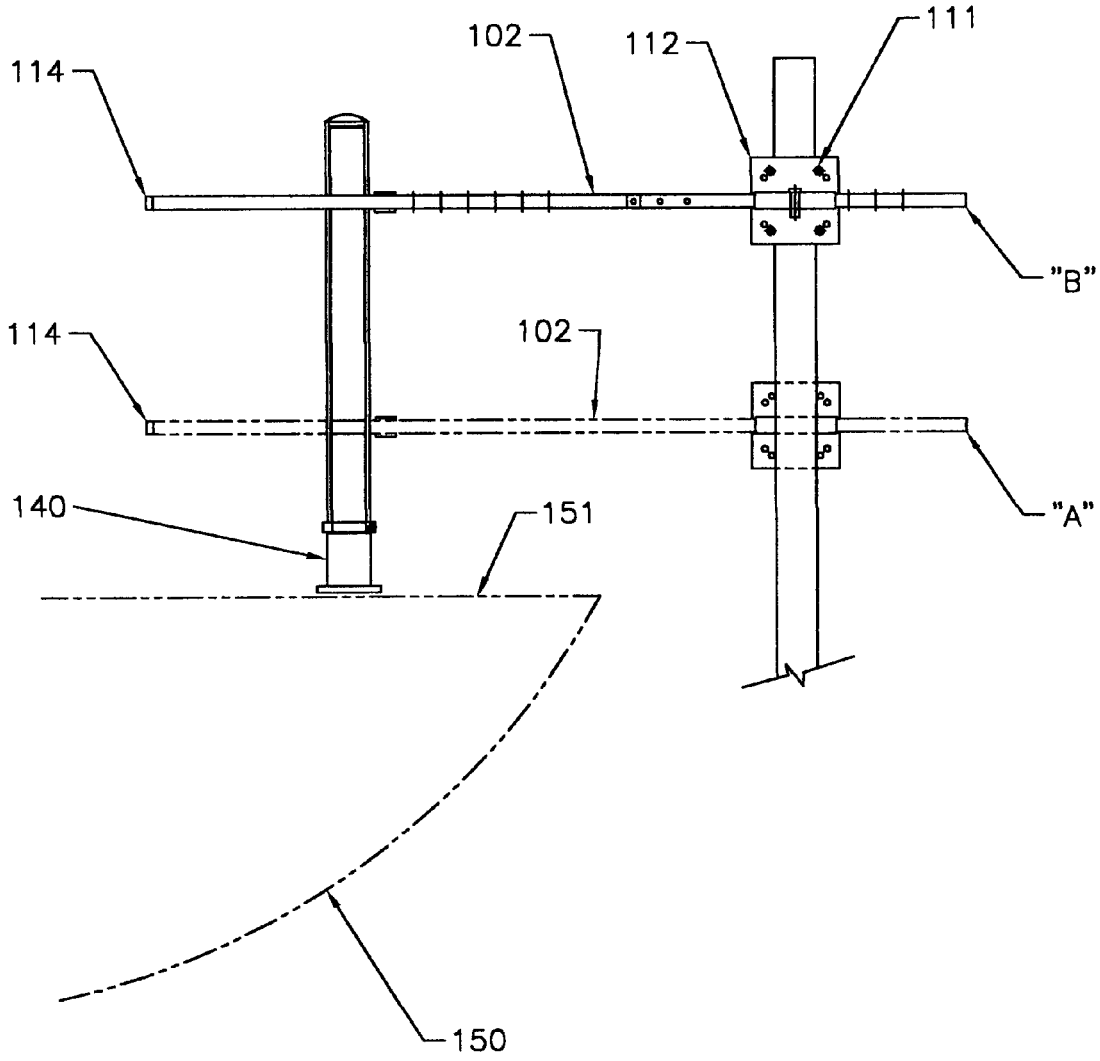
FIG. 5 shows the vertical adjustment characteristics of the invention with a side view.

FIG. 5 shows a side view of the boat-trailer launch & recovery device 114 with its vertical adjustments. Shown is boat bow post 107 which is reversible affixed tot he work piece boat bow deck 151 with a socket 140. Socket 140 is affixed to the boat deck work piece 151. PVC sleeve 265 freely rotates around pipe 266. Left rail 102 is shown attached to the optional work piece trailer post 113 with four or more holes in plate 112 and bolts 111. The height of rail shown in side view as 102 may be adjusted to various positions. For example, position A shown in outline is a lower position for a boat with a lower bow.

Position B can be used with a boat with a taller bow. These positions can be adjusted with plates 112 and 111.

Figure 6:
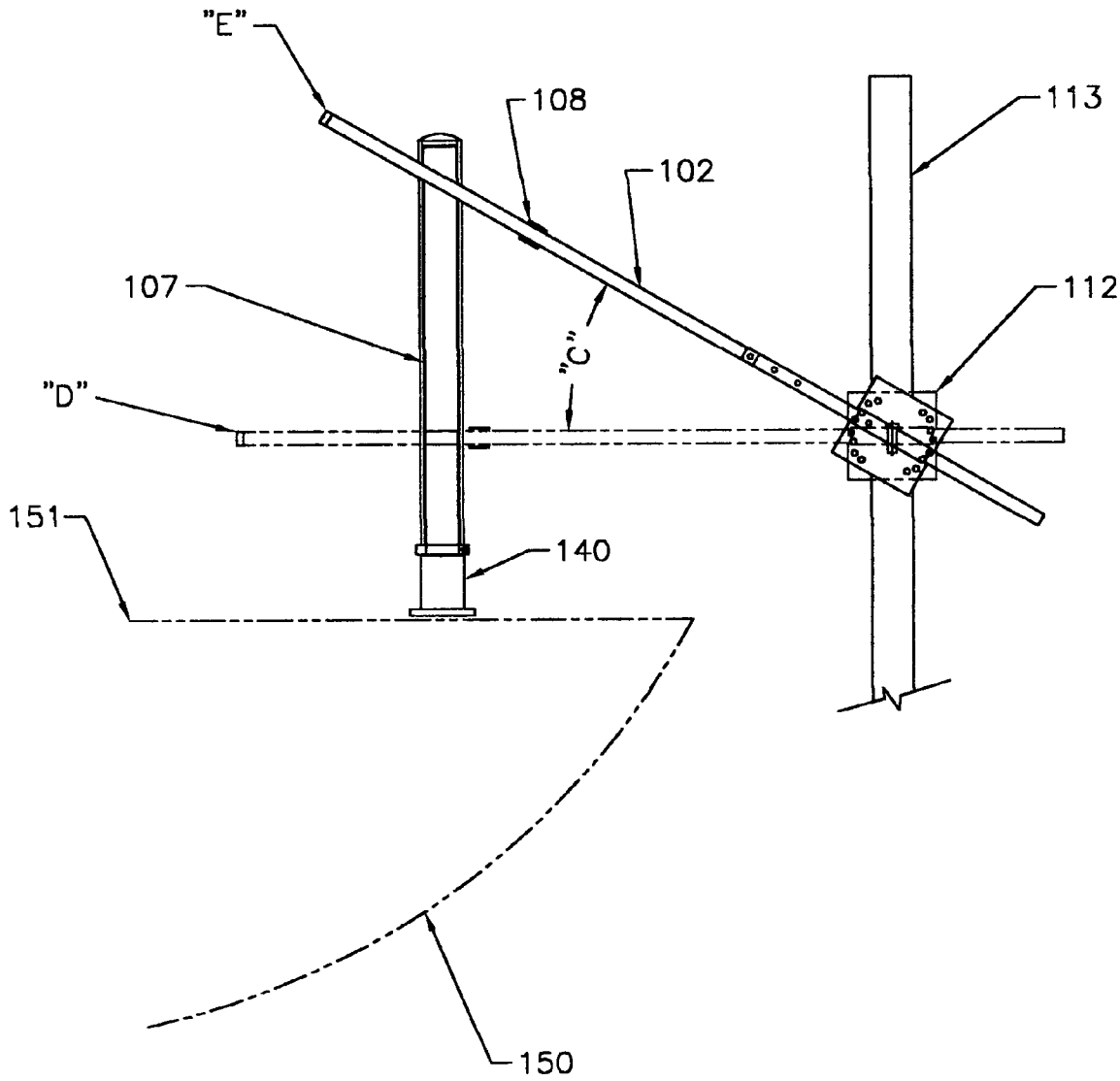
FIG. 6 shows an alternative vertical adjustment characteristics of the boat-trailer launch & recovery device.

FIG. 6 shows in a side view an alternative vertical adjustment characteristics of the boat-trailer launch & recovery device 114. Shown is boat bow post 107 which is reversible affixed to the work piece boat bow deck 151 with a socket 140. Socket 140 is affixed to the boat deck work piece 151. Left rail 102 is shown attached to the optional work piece trailer post 113 with holes in plate 112 and bolts 111. The angle C of the rail 102 can be adjusted with plates 112 and bolts 111. Depending upon the heights of the bow of the boat and the angle of the launch ramp, the boat-trailer launch & recovery device may be adjustable, essentially horizontal with the trailer as shown in position D or at an acute angle as shown at Position E.

SUMMERY OF INVENTION

The goal to be achieved is a one-man launch and recovery of the boat. Generally the current procedures are a two person operation. This Boat-Trailer Launch & Recovery Device has a right rail and a left rail, which rails are attached to a trailer post by holding plates. The right rail and the left rail each have a bend section. A spring loaded gate is attached to either the right rail or left rail. A stop bar connects the right rail and the left rail between the spring loaded gate and the trailer post.

Attached to the bow of the work piece boat is a removable bow post, which bow post has a socket, an inner core pipe section, and an out PVC sleeve which freely rotates around the inner core pipe sections. The PVC Sleeve section is held in place with a collar and a collar set screw and top cap. The right rail and the left rail mounting plates each have four or more bolt holes to adjust the height of the rails, one or more gate adjustment holes in right or left rail.

I claim:

1. A boat-trailer launch and recovery device comprising:

a right rail and a left rail;

said right rail and said left rail are affixed to a trailer post by holding plates;

said right rail has a right rail bend section;

said left rail has a left bend section;

affixed to bow of workpiece boat is a removable bow post;

a spring loaded gate is attached to one of either the right rail or the left rail;

a stop bar connects said right rail and said left rail between said spring loaded gate and said trailer post.

2. A boat-trailer launch and recovery device as in claim 1) where in said right rail and said left rail has one or more trailer post adjustment holes.

3. A boat-trailer launch and recovery device as in claim 1) wherein said right rail or said left rail has two one or more gate holes.

4. A boat-trailer launch and recovery device as in claim 1) wherein said holding plates have four or more bolt holes.

5. A boat-trailer launch and recovery device as in claim 1) where in said bow post further comprises a socket;

an inner core pipe section;

and outer PVC sleeve which freely rotates over said inner core pipe section;

said PVC sleeve is held in place with a sleeve and a sleeve set screw;

and a cap.

* * * * *